United States Patent [19]

Dalal

[11] Patent Number: 4,599,865

[45] Date of Patent: Jul. 15, 1986

[54] PROCESS FOR GENERATING STEAM FOR POWER GENERATION BY UTILIZING HYDROGEN AND OXYGEN OBTAINED BY ELECTROLYSIS OF WATER

[76] Inventor: Rajendra P. Dalal, 17/73, Netaji Subhash Rd., Bombay 400 020, India

[21] Appl. No.: 693,338

[22] Filed: Jan. 22, 1985

[30] Foreign Application Priority Data

Oct. 19, 1984 [IN] India ..... 289/BOM/84

[51] Int. Cl.[4] ..... F01K 21/00

[52] U.S. Cl. ..... 60/673; 60/670; 60/721; 431/10; 431/351

[58] Field of Search ..... 60/673, 721, 652, 659, 60/670; 431/10, 351

[56] References Cited

U.S. PATENT DOCUMENTS 3,459,953 8/1969 Hughes ..... 60/721 X

*Primary Examiner*—Allen M. Ostrager

*Attorney, Agent, or Firm*—Burke-Robertson, Chadwick & Ritchie

[57] ABSTRACT

A method and apparatus for combustion of hydrogen to produce heat, for example to generate steam for power generation. Water is electrolyzed and the hydrogen and a fraction of the oxygen products of electrolysis are passed immediately to a first combustion zone where the immediate combustion of the oxygen products and a function of the hydrogen products is effected. The products from this first combustion zone are immediately passed to a second combustion zone where combustion is again effected with the remaining fraction of the oxygen products of the electrolysis and the remaining hydrogen products from the first combustion zone. The heat generated is thereafter applied to the desired use, for example by passing the products of combustion from the second combustion zone through water to boil the water, the steam thereby produced being used for power generation. Apparatus to carry out this method is also described.

10 Claims, 4 Drawing Figures

PROCESS FOR GENERATING STEAM FOR POWER GENERATION BY UTILIZING HYDROGEN AND OXYGEN OBTAINED BY ELECTROLYSIS OF WATER

The present invention relates to a method and apparatus for combustion of hydrogen to produce heat, for example for generating steam for power generation.

BACKGROUND OF THE INVENTION

Hydrogen for use as a fuel, for example to generate steam for power generation, has previously been stored in cylinders for subsequent combustion. According to the present invention, a method of combustion of hydrogen is provided which generates much more heat than such traditional hydrogen combustion methods.

SUMMARY OF THE INVENTION

According to the present invention there is provided a method of combustion of hydrogen to produce heat, which method comprises electrolysing water and passing the hydrogen products and a fraction of the oxygen products of this electrolysis immediately to a first combustion zone for effective combustion there of the hydrogen products and this fraction of the oxygen products. Then, immediately thereafter, the products from this first combustion zone and the remaining fraction of the oxygen products from the electrolysis are passed to a second combustion zone for combustion. The heat produced is applied to a desired use.

The products of combustion from the second combustion zone may, for example, be passed through water to boil the water. The steam thereby produced can be used for power generation according to traditional techniques.

According to the present invention there is also provided an apparatus for generating steam from water for power generation, the apparatus comprising a pair of independent means for electrolysis of water and with first and second combustion chambers. Means are provided to pass hydrogen products from both the means for electrolysis of water to the first combustion chamber, and to pass oxygen products from one of the means for electrolysis of water to the first of the combustion chambers and from the other of the means for electrolysis of water to the second combustion chamber. A valve controlled passageway is provided between the combustion chambers to permit controlled fluid communication between these chambers. Ignition means are associated with each combustion chamber to permit ignition of the hydrogen and oxygen products in each combustion chamber at predetermined times. Finally, heat transfer means are provided to receive the combustion products from the second combustion chamber and pass them through the water to be changed to steam.

In a preferred embodiment, a high voltage induction means is associated with the means to pass hydrogen products from one of the means for electrolysis of water to the combustion chamber. This high voltage induction means is used for generating hydrogen ions from the hydrogen products passing threrethrough.

The method and apparatus of the present invention generate much heat than the normal combustion of hydrogen.

BRIEF DESCRIPTION OF THE DRAWINGS

These and other objects and advantages of the invention will become apparent upon reading the following detailed description and upon referring to the drawings in which.

Figure 1:
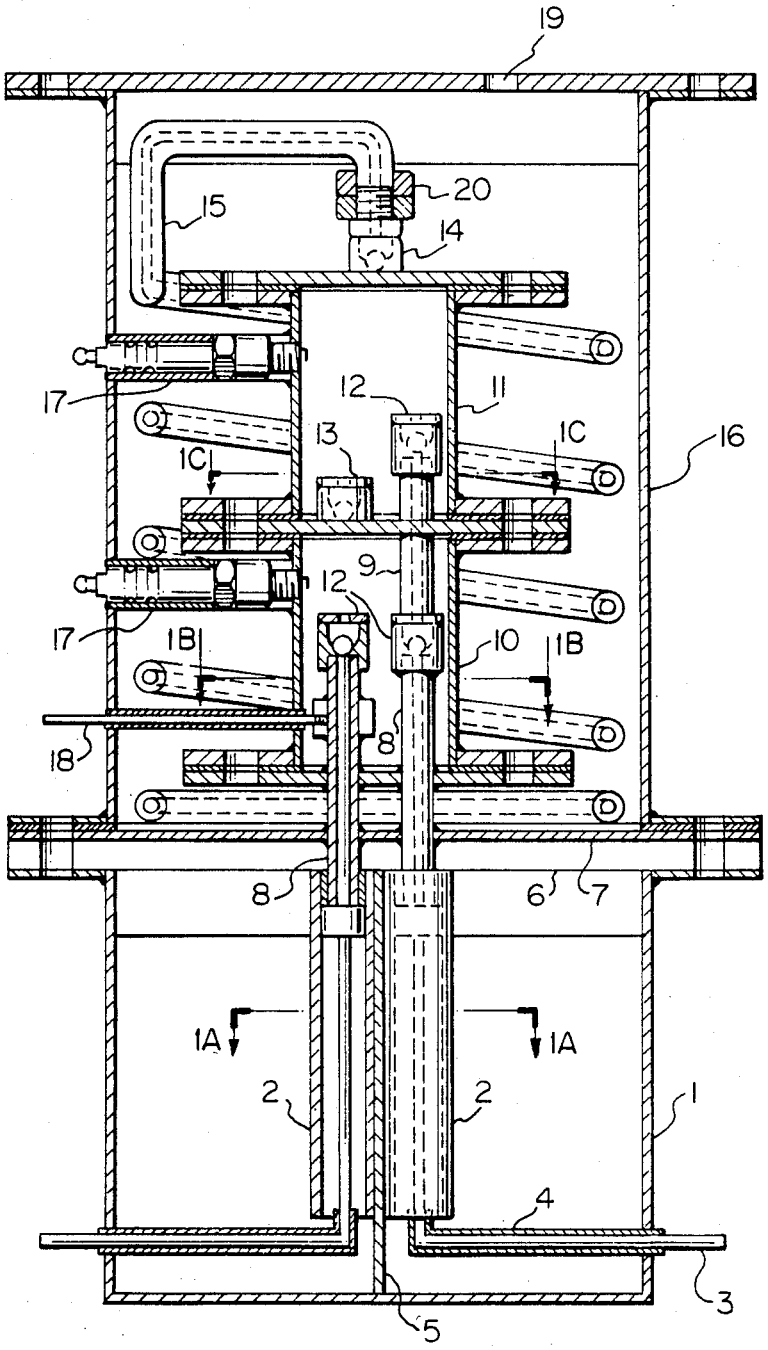
FIG. 1 is a schematic side view, in section, of an apparatus for carrying out the process according to the present invention.
Figure 1A:
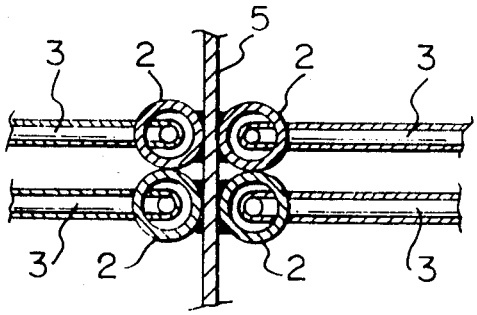
Figure 1B:
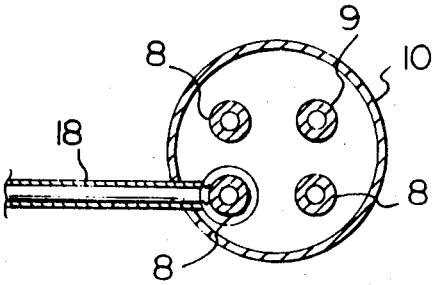
Figure 1C:
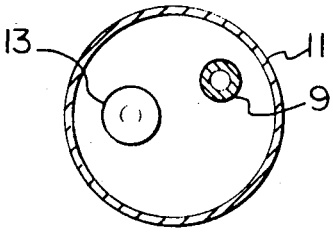

SECTION A is a section view along line A—A of FIG. 1;

SECTION B is a section view along line B—B of FIG. 1; and

SECTION C is a section view along line C—C of FIG. 1.

While the invention will be described in conjunction with an example embodiment, it will be understood that it is not intended to limit the invention to such an embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

The apparatus and process of the present invention permit the efficient use of hydrogen by forming very small amounts of deuterium by igniting a mixture of H(atomic) and $H^+$(protons) in the presence of oxygen. The deuterium thus formed reacts with oxygen forming deuterium oxide (heavy water). The remaining hydrogen and oxygen, being largely in the atomic state, combine much more violently generating much more heat than normal hydrogen would.

The apparatus as illustrated consists of two electrolytic cells (1) which generate hydrogen and oxygen by electrolysis of acidulated water. Electrodes (3) are insulated (4) so that the products of electrolysis, hydrogen and oxygen, are generated only inside the tubes (2) and are discharged into the combustion chambers (10 and 11) through the attached tubes (8 and 9). All the hydrogen generated by the two electrolytic cells is discharged into the first combustion chamber (10) through a simple ball valve (12). Oxygen from one electrolytic cell is discharged into first combustion chamber (10) and from the other into the second combustion chamber (11). One of the tubes carrying hydrogen is connected by an insulated rod (18) to a high voltage induction coil (not shown). This drains electrons from hydrogen atoms in the tube, generating protons. The induction coil induces impulses of high voltage at fairly high frequency. The mixture of gases in the first combustion chamber (10) thus consists of H, $H^+$, $H_2$ and O. With spark plug (17), sparking continuously at a fairly high frequency, H and $H^+$ will react forming $D_2$ which in turn will react with O, forming $D_2O$. The amount of $D_2$ formed will depend on the number of protons generated by the high voltage induction in the tube containing hydrogen. The generation of protons is at random. The remaining H and $H_2$ will also react with the remaining O to form super heated steam.

In this first combustion chamber there will be some hydrogen which has not gone through combustion as there is insufficient oxygen in this first combustion chamber for complete combustion of the hydrogen. The contents in this chamber are at very high temperature and pressure.

These products of combustion pass through a ball valve (13) into the second combustion chamber (11). Oxygen is discharged into this chamber through a tube (9) and valve (12). Second ignition takes place in this chamber by means of a spark plug (17). On ignition, that hydrogen which was not subjected to combustion in the first combustion chamber will combine with oxygen to form super heated steam.

The super heated mixture of $H_2O$ and $D_2O$ pass through valve (14) into a flue tube (15) which is connected to it by nuts (20) as shown. The flue gases are circulated through the flue tube (15) inside the boiler vessel (16) containing water. Upon transfer of heat, the water in the boiler vessel (16) is converted into steam. This steam can be utilized through a pressure valve (not shown) connected at 19.

The general assembly of the electrolytic cells is connected to the boiler vessel by means of flanges, plate and volts and there is an insulating board (6) between the two. Similarly, the two combustion chambers are assembled together by plates, flanges and bolts, as shown.

The apparatus shown is only a fundamental unit for steam generation. A number of such units can be grouped together, depending on the size of the power generation unit.

According to the process and apparatus of the present invention, generation of excess heat is prevented by separation of the hydrogen combustion steps. The supplying of additional required oxygen to the second combustion chamber to complete the reaction by the second ignition in that chamber in fact permits greater control of the heat generated.

Thus it is apparent that there has been provided in accordance with the invention a method and apparatus for combustion of hydrogen to produce heat that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A method of combustion of hydrogen to produce heat, which method comprises the steps of (1) electrolysing water, (2) passing the hydrogen products and a fraction of the oxygen products of this electrolysis immediately to a first combustion zone for combustion there of this fraction of oxygen products and a fraction of the hydrogen products, (3) after combustion immediately passing the products from this first combustion zone and the remaining fraction of the oxygen products from the electrolysis to a second combustion zone for combustion, and (4) applying the heat produced to a desired use.

2. A method according to claim 1 which comprises passing the products of combustion from the second combustion zone through a heat transfer zone to collect the heat and applying it to the desired use.

3. A method according to claim 1 wherein a fraction of the hydrogen products of the electrolysis are subjected to high voltage induction to form protons before being passed to the first combustion zone.

4. A method according to claim 1 wherein the products of combustion from the second combustion zone are passed through water to boil the water, the steam thereby produced being used for power generation.

5. A method according to claim 1 wherein about one-half of the oxygen products of electrolysis are passed for combustion to the first combustion zone and the remaining oxygen products of electrolysis are passed for combustion to the second combustion zone.

6. A method according to claim 4 wherein about one-half of the oxygen products of electrolysis are passed for combustion to the first combustion zone and the remaining oxygen products of electrolysis are passed for combustion to the second combustion zone.

7. Apparatus for generating steam from water for power generation comprising:

(a) a pair of independent means for electrolysis of water;

(b) first and second combustion chambers;

(c) means to pass hydrogen products from both the means for electrolysis of water to the first combustion chamber;

(d) means to pass oxygen products from one of the means for electrolysis of water to the first of the combustion chambers;

(e) means to pass oxygen products from the other of the means for electrolysis of water to the second combustion chamber;

(f) a valve controlled passageway between the combustion chambers to permit controlled fluid communication between these chambers;

(g) ignition means associated with each combustion chamber to permit ignition of the hydrogen and oxygen products in each combustion chamber at predetermined times; and (h) heat transfer means to receive the combustion products from the second combustion chamber and pass them through the water to change the water to steam.

8. Apparatus according to claim 7 further comprising high voltage induction means associated with the means to pass hydrogen products from one of the means for electrolysis of water to the combustion chamber, for generating hydrogen ions from the hydrogen products passing therethrough.

9. Apparatus according to claim 7 wherein the ignition means comprise spark plugs.

10. Apparatus according to claim 7 wherein a boiler vessel circumscribes the combustion chamber means, and a coil to carry combustion gases from the second combustion chamber passes through the boiler vessel.

* * * * *